US007240388B2

(12) United States Patent
Warford

(10) Patent No.: US 7,240,388 B2
(45) Date of Patent: Jul. 10, 2007

(54) ADJUSTABLE QUICK DISCONNECT PORTABLE WHEEL CHAIR RAMP

(76) Inventor: Larry Eugene Warford, P.O. Box 1170, Buckley, WA (US) 98321

( * ) Notice: Subject to any disclaimer, the term of this patent is extended or adjusted under 35 U.S.C. 154(b) by 0 days.

(21) Appl. No.: 11/037,762

(22) Filed: Jan. 19, 2005

(65) Prior Publication Data

US 2006/0156492 A1 Jul. 20, 2006

(51) Int. Cl.
*E01D 19/10* (2006.01)

(52) U.S. Cl. ..... 14/69.5

(58) Field of Classification Search ..... 14/69.5
See application file for complete search history.

(56) References Cited

U.S. PATENT DOCUMENTS

| | | | | |
|---|---|---|---|---|
| 3,009,183 | A | 11/1961 | Lay | |
| 3,818,528 | A | 6/1974 | Peterson | |
| 4,084,713 | A | 4/1978 | Rohrs et al. | |
| 4,528,711 | A | 7/1985 | Packer | |
| 5,259,081 | A | 11/1993 | Henderson | |
| 5,671,496 | A | 9/1997 | Smith | |
| 6,481,036 | B1 | 11/2002 | Duvall | |
| 6,561,228 | B1 | 5/2003 | Lennartsson | |
| 6,810,995 | B2 | 11/2004 | Warford | |
| 2006/0059636 | A1 * | 3/2006 | Suggate | 14/69.5 |

* cited by examiner

*Primary Examiner*—Raymond Addie
(74) *Attorney, Agent, or Firm*—David L. Tingey

(57) ABSTRACT

A modular portable wheel chair ramp comprising a plurality of mechanically interconnected modular ramp sections. Ramp sections are supported by adjustable post assemblies on ramp section sides. A rail panel comprising upper and lower rails extend between said outer post on one end and a second post matching in complement the outer post on an opposite end wherein said second post of a first rail panel removably connects to an outer post of an adjacent rail panel therein connecting said rail panels together. Slats connecting between upper and lower rails form a rail panel. An inner rail is also secured between the posts, interlocking with an extended lug on an inner rail section end fitting into a matching hole in an adjacent inner rail section end to make a continuous inner section rail.

13 Claims, 5 Drawing Sheets

ADJUSTABLE QUICK DISCONNECT PORTABLE WHEEL CHAIR RAMP

BACKGROUND

1. Field of the Invention

This invention relates to ramps and more specifically to a light-weight and portable wheel chair ramp adjustable in height and easy to assemble.

2. Prior Art

It is known to have wheel chair ramps. The American Disability Act (ADA) requires that wheelchair ramps be placed in all public entry ways, thus insuring entrance to all. Although portable wheelchair ramps, even modular ramps, have long been used in various types of construction, the standards for these ramps have become more stringent, precluding the use of many prior wheelchair ramps. It is not known previously to have a modular wheel chair ramp that is portable and easy to install and that also complies with the ADA. Thus it is the objective of the present invention to provide a ramp suitable for wheel chair use that is modular, adjustable in height, light-weight, easy to assemble and disassemble, and still comply with the ADA with a high safety factor.

SUMMARY OF THE INVENTION

These objectives are achieved in a portable wheel chair ramp comprising a plurality of mechanically interconnected modular ramp sections. Ramp sections interconnect end to end with a J-hook interlocking with a key-way on adjacent ramp ends. A bar below the hook extends into the key-way to further engage adjacent ramp ends, preventing relative vertical movement between the adjacent ramps.

Adjustable length post assemblies on each ramp side support the ramp sections at preferred heights, providing an incline to the collective ramp. On a lowest ramp section, ramp legs pivot from a storage position adjacent a section to vertical for ramp assembly. On other ramp sections, a lower post supports the ramp from the ground. A tubular inner post is assembled over a ramp lower post on each ramp section with ramp posts on each ramp side, secured thereto by a bolt. The bolt passes through a slot in the ramp lower post into a bolt moveable along the slot to provide an adjustable relative position of the inner post to the ramp lower post. A tube extending from a ramp section then slides over the inner post, coming to rest on a supporting platform of the inner post. A tubular outer post then slides over the installed inner post to the ramp tube.

Slats connecting between upper and lower rails form a rail panel. On one end of the rail panel is the outer post. On the other end is an angle post adapted to abut the outer post of an adjacent rail panel and overlap a side of that outer post, connected thereto by a bolt.

An inner rail is also secured between the posts, interlocking with an extended lug on an inner rail section end fitting into a matching hole in an adjacent inner rail section end to make a continuous inner section rail.

As noted a first bolt is employed to adjustably secure the inner post to the lower post. A single second bolt at each post assembly is employed to secure the outer post and the overlapping angle post of an adjacent rail panel, the inner post and the inner rail together making assembly quick and simple.

DETAILED DESCRIPTION OF THE PREFERRED EMBODIMENT

Figure 1:
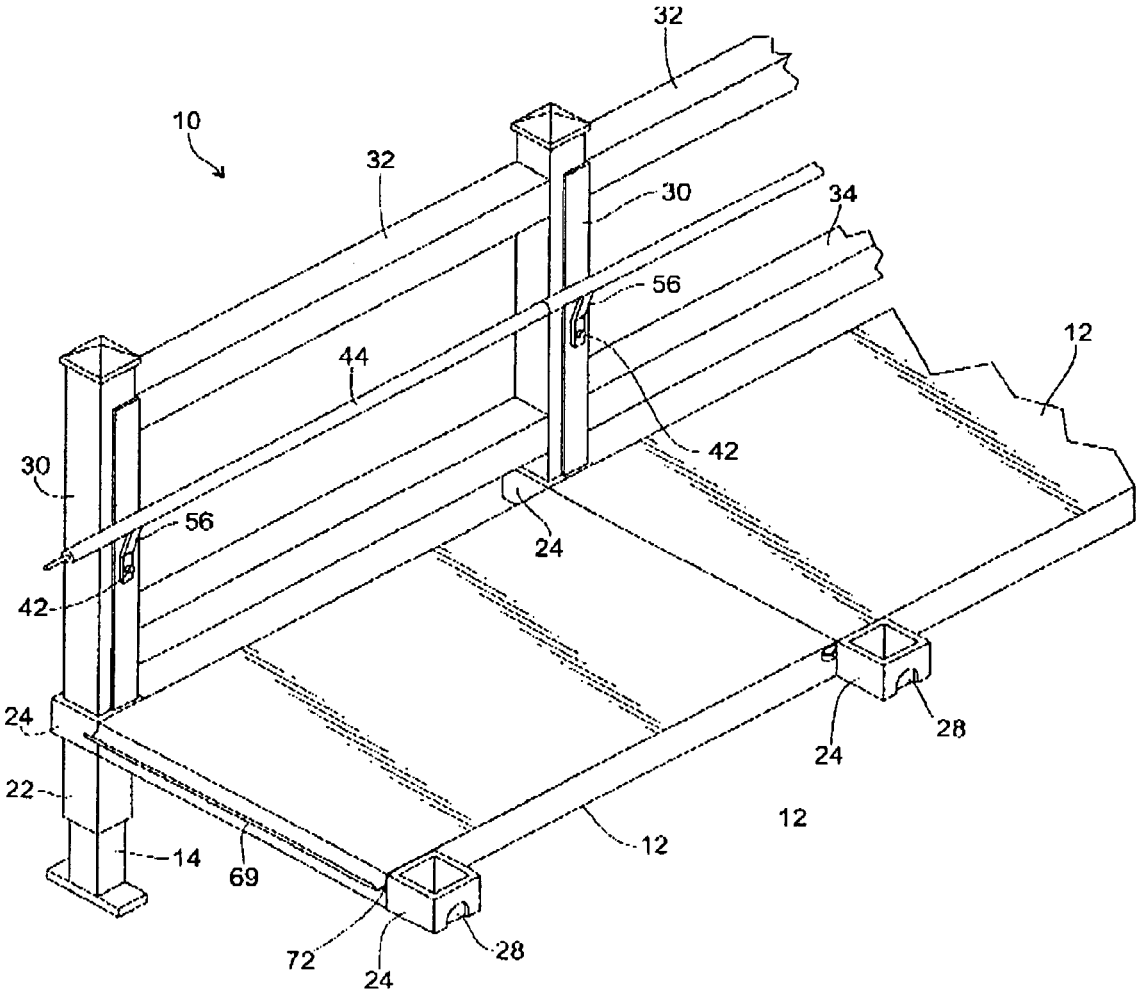
FIG. 1 is a perspective view of the modular wheelchair ramp of the present invention.
Figure 2:
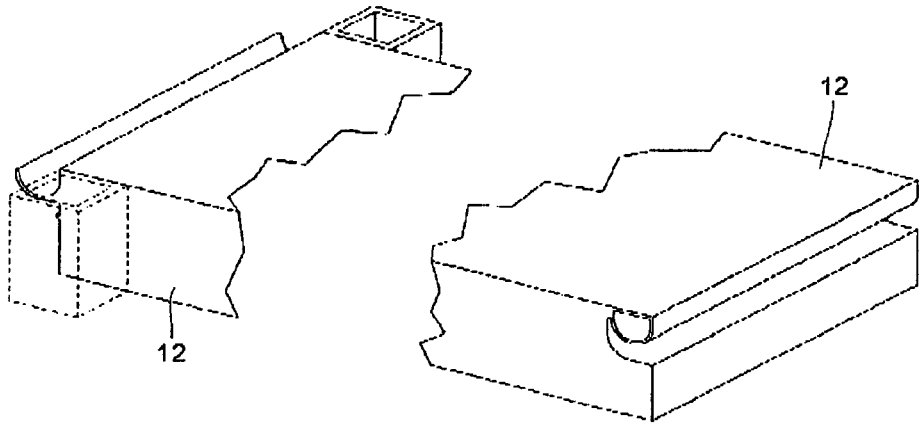
FIG. 2 is perspective view is a perspective view of a ramp section showing ends adapted for interconnecting with adjacent panels.
Figure 3:
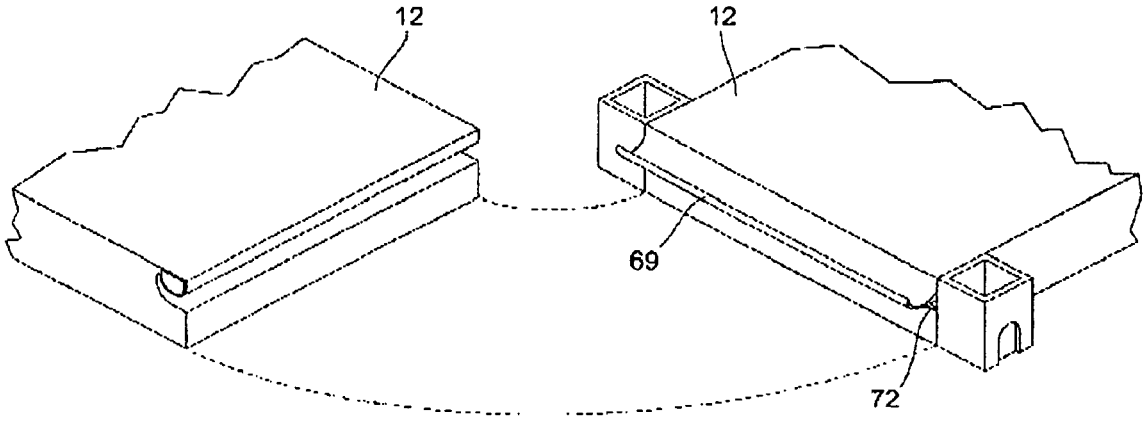
FIG. 3 is a perspective view of ends of adjacent ramp panels adapted for interconnecting.
Figure 4A:
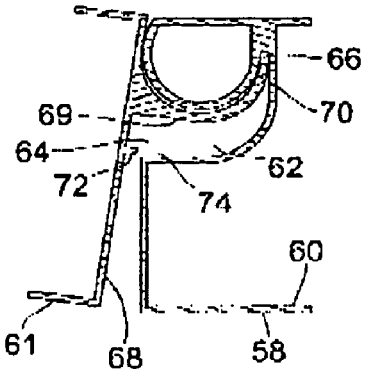
FIG. 4*a* is a cross-sectional view of a ramp section end partially interlocking with an adjacent ramp section.
Figure 4B:
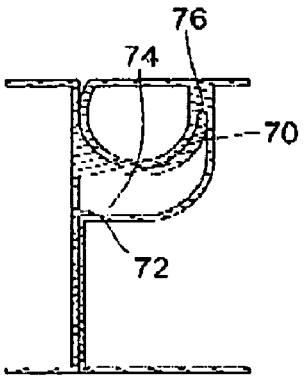
FIG. 4*b* is a cross-sectional view of a ramp section end interlocking with an adjacent ramp section.
Figure 5:
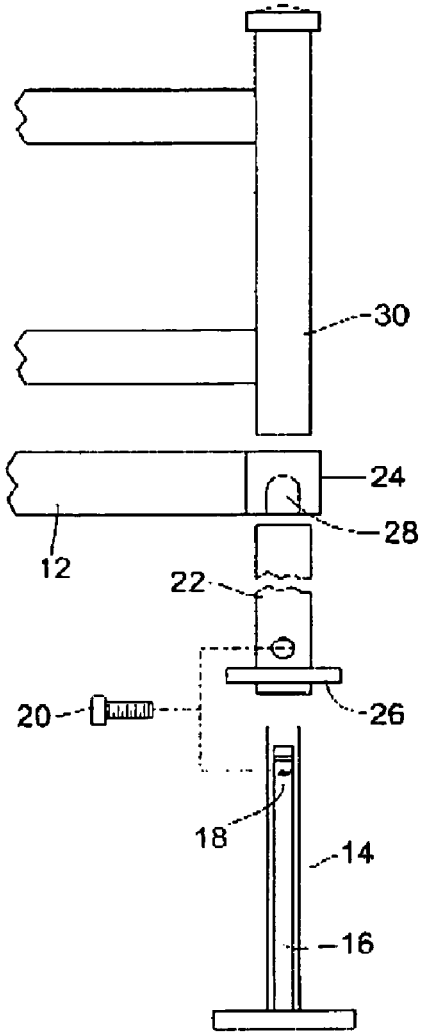
FIG. 5 is an exploded view of a post assembly.
Figure 6:
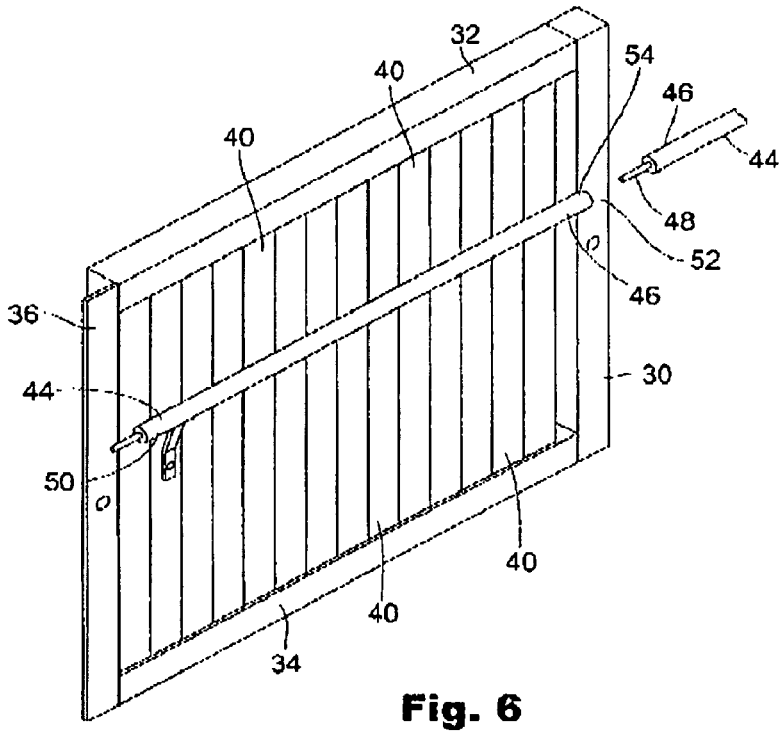
FIG. 6 is a perspective view of a rail panel.
Figure 7:
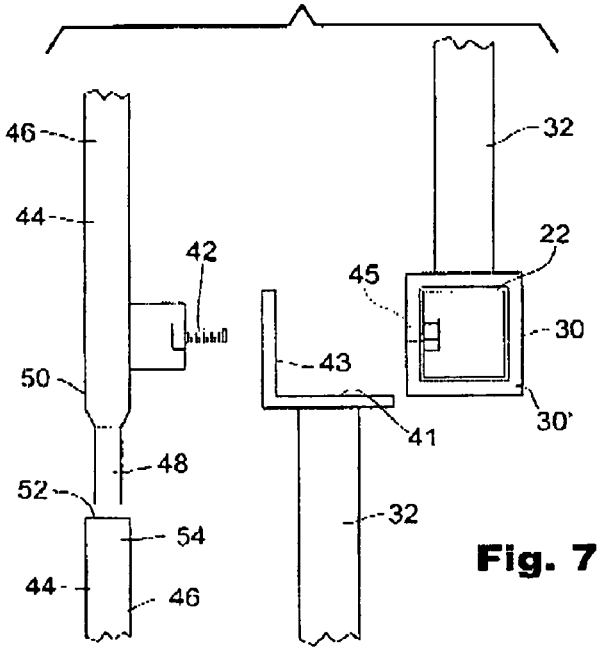
FIG. 7 is a top exploded view showing interconnection of adjacent ramp sections and an inner rail.
Figure 8:
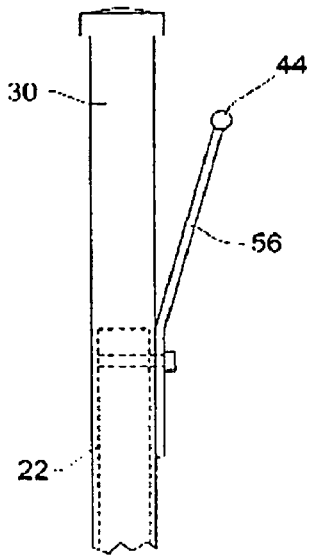
FIG. 8 is an end view of a rail panel with an attached inner rail.
Figure 9:
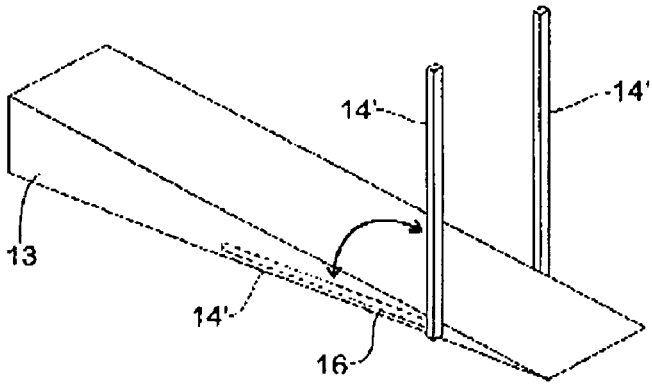
FIG. 9 is a perspective view of a first ramp section, showing pivoting tower posts.
Figure 10:
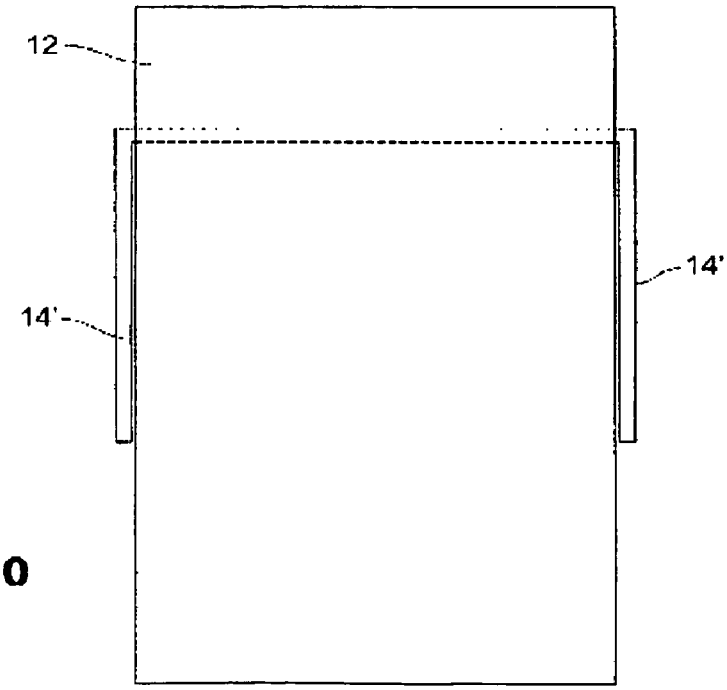
FIG. 10 is a top view of the first ramp section, showing pivoting lower legs alongside the ramp section.

The modular ramp 10 of the present invention comprises a plurality of ramp sections 12. For each ramp section 12, lower posts 14 are provided on which each ramp section 12 is supported. Each lower post 14 includes a slot 16 with a threaded nut 18 adjustable within the lower post 14 accessible through the slot 16 for receiving first bolt 20. A tubular inner post 22 slides over a lower post 14 and is secured to the lower post 14 at an adjustable preferred position by first bolt 20.

A first ramp section 13, lowest in the ramp sections connected end to end, adapted to engage ground, has lower posts 14' that pivot between a storage position 16 alongside the ramp section 12 and vertical for assembly of the ramp. Pivoting lower posts 14' are employed because of the lack of ground clearance for an independent lower post 14 and because the first ramp section 13 tapering to the ground lacks sufficient structural support to which a post could be connected.

Each said ramp section 12 (except first ramp section 13) includes a tube 24 extending securely from each ramp section 12 and opening upward that slides over the inner post 22 and rests on inner post support platform 26, thus connecting the selected ramp section and the inner post 22. The tube 24 includes a pocket 28 that allows the inner post to pass over first bolt 20. Tubular outer post 30 then also slides over inner post 22.

Parallel upper and lower rails 32 and 34 extend between outer post 30 on one end and angle post 36 on the other end, which angle post 36 matches in complement outer post 30 when an outer post of a first rail panel is brought together for mutual connection with an angle post of an adjacent panel. The angle post 36, outer post 30, and upper and lower rails 32 and 34 together form a rail panel 38. Slats 40, typically vertical, extend between the upper and lower rails 32, 34. An angle post first face 41 of outer post 30 a first rail panel 38' abuts outer post 30' of an adjacent rail panel 38" and an angle post second face 43 overlaps that outer post 30'. A second bolt 42 through a hole 45 in the overlapping angle post second face 43 and a matching hole 45' in the adjacent rail panel 38' secures the adjacent panels 38' and 38" together.

Several such rail panels 38 are similarly secured together to collectively extend the length of the ramp 10.

An inner rail 44, useful as a hand rail, extends the length of the combined rail panels 38. The inner rail 44 comprises a plurality of inner rail segments 46 interconnected with an extended lug 48 protruding longitudinally from an inner rail segment end 50 and received into a matching segment hole 52 in an adjacent inner rail segment end 54 forming continuous inner rail 44. The inner rail 44 is supported by a brace 56 that is also bolted to an angle post 36 and overlapping post second face 43 of adjacent outer post 30 all by second bolt 42.

Ramp sections 10 are interconnected end to end. A first connection end 60 of each lower ramp section 58 includes a keyway 62 with an entry opening 64 turning upward into an internal cavity 66. Each upper ramp section 61 with an upper ramp section connection end 68, adjacent a said lower ramp section 58, includes a tongue 69 in J shape with a tongue hook 70 entering the key-way 62 of the lower ramp section 58 and upward into the internal cavity 66 as the upper second ramp section 60 is lowered into end to end alignment with the lower ramp section 58. A bar 72 transverse across the upper section connection end 68 extends therefrom and into the keyway when the connection ends 60, 68 are brought together, the bar at the keyway bottom 74 and the tongue hook 70 at the top 76 of the internal cavity 66 preventing vertical movement between the connected ramp sections as the tongue hook 70 in the keyway 62 and internal cavity 66 prevents horizontal movement.

The invention claimed is:

1. A modular ramp, useful for wheelchairs, comprising:

a. a plurality of ramp sections removably interconnected end to end;

b. a post assembly comprising i. a lower post on each side of a ramp section;

ii. an inner post adjustably connected in height to each lower post;

iii. a said ramp section removably connected to said inner post;

iv. an outer post; removably connected to said inner post;

c. a rail panel comprising upper and lower rails extending between consecutive outer posts, which further comprise first and second vertical post segments, said first and second vertical post segments being disposed on respective panel ends and complimentary to one another, such that, said first vertical post segment of a rail panel removably connects to a second vertical post segment of an adjacent rail panel therein joining said rail panels together.

2. The ramp of claim 1 further wherein the lower post further comprises a vertical slot with a threaded nut vertically adjustable within the slot wherein the inner post slides over the lower post to a preferred relative position in height, the inner post then bolted to the lower bolt with a bolt passing through a lower bolt hole into threaded engagement with the threaded nut.

3. The ramp of claim 1 wherein said ramp section includes a tube on each side of a lower end, which tube removably slides over said inner post.

4. The ramp of claim 3 wherein said outer post is tubular, sliding over the inner post after the ramp section tube.

5. The ramp of claim 1 wherein adjacent ramp sections further comprise on a first connection end of a lower ramp section a keyway with an entry opening turning upward into an internal cavity, and adjacent said lower ramp section, on an adjacent upper ramp section connection end a tongue with a tongue hook adapted to enter the keyway of the lower ramp section and upward into the internal cavity as the upper second ramp section is lowered into end to end alignment with the lower ramp section.

6. The ramp of claim 5 further comprising a bar transverse across the upper ramp section connection end extending therefrom and into the keyway when the connection ends are brought together, the bar at the keyway bottom and the tongue hook at the top of the internal cavity therein preventing vertical movement between the connected ramp sections as the tongue hook in the keyway prevent longitudinal movement.

7. The ramp of claim 6 further comprising slats that connected between said upper and lower rails.

8. The ramp of claim 1 further comprising a first ramp section, lowest in the ramp sections connected end to end, including lower posts pivotably connected thereto movable between a storage position alongside the ramp section and vertical.

9. The ramp of claim 1 further comprising an inner rail, useful as a hand rail, extending the length of the combined rail panels.

10. The ramp of claim 9 wherein the inner rail comprises a plurality of interconnected inner rail segments with an extended lug protruding longitudinally from an inner rail segment end and received into a matching segment hole in an adjacent inner rail segment end forming said inner rail.

11. The ramp of claim 10 wherein said inner rail is supported by a brace bolted to said connected vertical posts of adjacent rail panels by a removable common bolt.

12. A modular ramp, useful for wheelchairs, comprising:

a. a plurality of ramp sections removably interconnected end to end wherein adjacent ramp sections further comprise, i. on a first connection end of a lower ramp section a keyway with an entry opening turning upward into an internal cavity, ii. adjacent said lower ramp section, on an adjacent upper ramp section connection end a tongue with a tongue hook adapted to enter the keyway of the lower ramp section and upward into the internal cavity as the upper second ramp section is lowered into end to end alignment with the lower ramp section; and iii. a bar transverse across the upper ramp section connection end extending therefrom and into the keyway when the connection ends are brought together, the bar at the keyway bottom and the tongue hook at the top of the internal cavity therein preventing vertical movement between the connected ramp sections as the tongue hook in the keyway prevent longitudinal movement;

b. a post assembly comprising i. a lower post on each side of a ramp section further comprises a vertical slot with a threaded nut vertically adjustable within the slot wherein the inner post slides over the lower post to a preferred relative position in height, the inner post then bolted to the lower bolt with a bolt passing through a lower bolt hole into threaded engagement with the threaded nut;

ii. a tubular inner post adjustably connected in height to each lower post;

iii. a said ramp section removably connected to said inner post wherein said ramp section includes a tube on each side of a lower end, which tube removably slides over said inner post;

iv. a tubular outer post; slidable over said inner post;

c. a rail panel comprising upper and lower rails extending between consecutive outer posts, which further comprise first and second vertical post segments, said first and second vertical post segments being disposed on respective panel ends and complimentary to one another, such that, said first vertical post segment of a rail panel removably connects to a second vertical post segment of an adjacent rail panel therein joining said rail panels together.

13. The ramp of claim 12 further comprising an inner rail, useful as a hand rail, extending the length of the combined rail panels, wherein the inner rail includes a. a plurality of interconnected inner rail segments with an extended lug protruding longitudinally from an inner rail segment end and received into a matching segment hole in an adjacent inner rail segment end forming said inner rail; and b. wherein said inner rail is supported by a brace bolted to said connected vertical posts of adjacent rail panels by a removable common bolt.

* * * * *